US008593384B2

(12) United States Patent
Yang

(10) Patent No.: US 8,593,384 B2
(45) Date of Patent: Nov. 26, 2013

(54) SYSTEM FOR DISPLAYING IMAGES

(75) Inventor: Jiun-Yan Yang, Zhubei (TW)

(73) Assignee: Chimei Innolux Corporation, Miaoli County (TW)

( * ) Notice: Subject to any disclaimer, the term of this patent is extended or adjusted under 35 U.S.C. 154(b) by 470 days.

(21) Appl. No.: 12/949,341

(22) Filed: Nov. 18, 2010

(65) Prior Publication Data

US 2011/0115700 A1 May 19, 2011

Related U.S. Application Data

(60) Provisional application No. 61/262,853, filed on Nov. 19, 2009.

(51) Int. Cl.
*G09G 3/36* (2006.01)

(52) U.S. Cl.
USPC ..... 345/87; 345/76; 345/102

(58) Field of Classification Search
USPC ..... 345/76–104
See application file for complete search history.

(56) References Cited

U.S. PATENT DOCUMENTS 6,285,422 B1 * 9/2001 Maeda et al. ..... 349/96
7,248,245 B2 7/2007 Adachi et al.

* cited by examiner

*Primary Examiner* — Kevin M Nguyen
*Assistant Examiner* — Cory Almeida
(74) *Attorney, Agent, or Firm* — McClure, Qualey & Rodack, LLP

(57) ABSTRACT

A system for displaying images includes a transflective display panel and a light source module oppositely disposed thereto. The light source module includes a light guide plate, a plurality of first light-emitting diodes (LEDs), a plurality of second LEDs, and a lighting control unit electrically connected to the pluralities of first and second LEDs. The light guide plate includes a first portion and a second portion corresponding to a first display region and a second display region of the transflective display panel, respectively. Each first LED is a white light-emitting diode and transmits an emitted light therefrom to the first display region by the first portion of the light guide plate. The plurality of second LEDs includes red, green, and blue LEDs and transmits an emitted light therefrom to the second display region by the second portion of the light guide plate.

11 Claims, 4 Drawing Sheets

SYSTEM FOR DISPLAYING IMAGES

CROSS REFERENCE TO RELATED APPLICATIONS

This application claims the benefit of U.S. Provisional Application No. 61/262,853, filed Nov. 19, 2009, the entirety of which is incorporated by reference herein.

BACKGROUND OF THE INVENTION

1. Field of the Invention

The invention relates to flat panel display (FPD) technology, and in particular to a transflective display device, which is capable of being operated in a constant lighting or field sequential mode.

2. Description of the Related Art

Flat panel display (FPD) devices are widely employed in electronic products, such as portable personal computers, personal digital assistants (PDAs), electronic books, projectors, mobile phones, and the like, due to their thin profiles, light weights and low power consumption when compared to conventional cathode ray tube (CRT) display devices. Such FPD devices include transmissive and reflective display devices, such as a liquid crystal display (LCD) device, an organic light-emitting display (OLED) device, an electrowetting display, and an electrophoretic display (EPD) device.

However, due to deficiencies, there is no transmissive and reflective display device that can completely meet the desires of users today. For example, transmissive display devices consume a notable amount of power due to backlight power requirements, and do not exhibit good performance when operating under sunlight. Meanwhile, reflective display devices exhibit relatively low contrast ratios and relatively poor color saturation when compared to transmissive display devices due to the use of ambient light as the light source. Also, self-emissive type OLED devices have similar problems as that described for transmissive display devices. Moreover, EPD devices have low response time, which causes functions, such as, the turning of a page, to be very slow. Accordingly, EPD devices can not be operated in video mode. Additionally, full color FPD devices require the use of a color filter, which reduces the resolution and brightness thereof.

Accordingly, there exists a need in the art for development of an improved FPD structure, which is capable of mitigating the deficiencies mentioned above.

BRIEF SUMMARY OF THE INVENTION

A detailed description is given in the following embodiments with reference to the accompanying drawings. Systems for displaying images are provided. An exemplary embodiment of a system for displaying images includes a transflective display panel having a first display region and a second display region adjacent thereto and a light source module oppositely disposed to the transflective display panel. The light source module includes: a light guide plate having a first portion and a second portion adjacent thereto, wherein the first portion corresponds to the first display region and the second portion corresponds to the second display region; a plurality of first light-emitting diodes transmitting an emitted light therefrom to the first display region by the first portion of the light guide plate; a plurality of second light-emitting diodes transmitting an emitted light therefrom to the second display region by the second portion of the light guide plate; and a lighting control unit electrically connected to the plurality of first light-emitting diodes and the plurality of second light-emitting diodes, such that the pluralities of first and second light-emitting diodes are operated in a constant lighting or field sequential mode. Each first light-emitting diode is a white light-emitting diode and the plurality of second light-emitting diodes includes red, green, and blue light-emitting diodes.

BRIEF DESCRIPTION OF DRAWINGS

The invention can be more fully understood by reading the subsequent detailed description and examples with references made to the accompanying drawings, wherein.

DETAILED DESCRIPTION OF INVENTION

The following description is of the best-contemplated mode of carrying out the invention. This description is provided for the purpose of illustrating the general principles of the invention and should not be taken in a limiting sense. The scope of the invention is best determined by reference to the appended claims.

Figure 1:
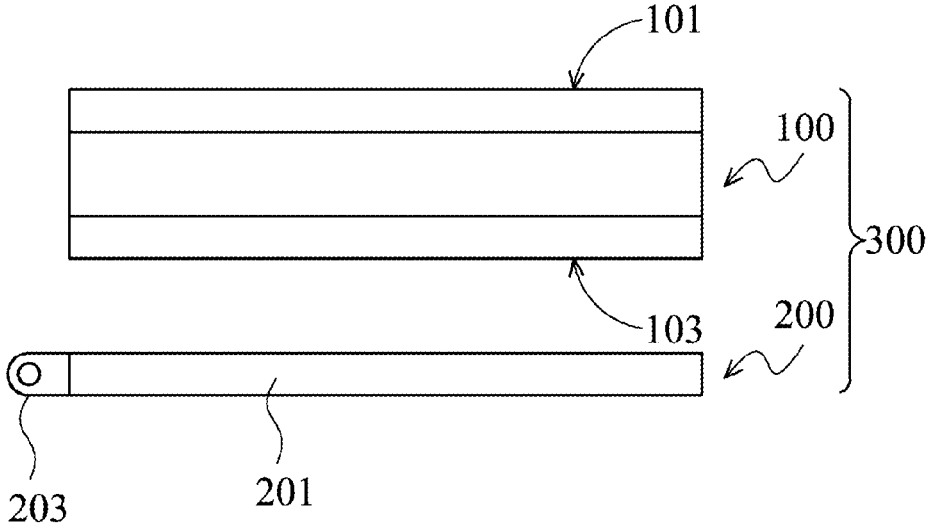
FIG. 1 is a cross section view of an embodiment of a system for displaying images, including an FPD device, according to the invention.

Systems for displaying images are provided. Referring to FIG. 1, which is a cross section view of an embodiment of a system for displaying images including a flat panel display (FPD) device 300, according to the invention. The FPD device 300 comprises a transflective display panel 100 and a light source module 200 oppositely disposed thereto. In the embodiment, the light source module 200 is a backlight module, and therefore it is disposed under a non-viewable side 103 of the transflective display panel 100. In another embodiment, the light source module 200 may be a front light module, and therefore it is disposed above a viewable side 101 of the transflective display panel 100.

Figure 2:
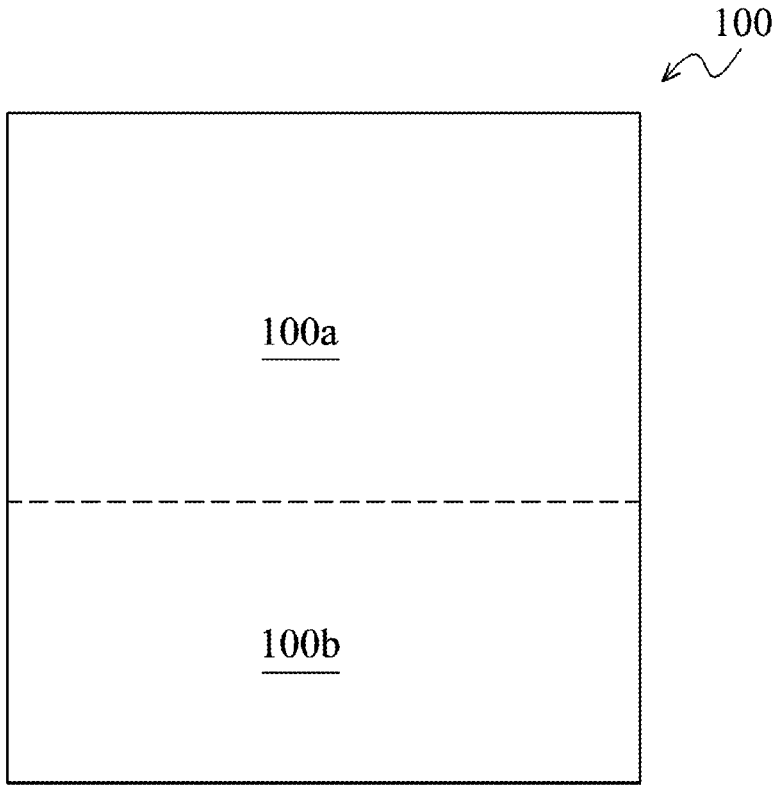
FIG. 2 is a plan view of the exemplary embodiment of the transflective display panel shown in FIG. 1.

Referring to FIG. 2, which is a plan view of the exemplary embodiment of the transflective display panel 100 shown in FIG. 1. In the embodiment, the transflective display panel 100 has a first display region 100*a* and a second display region 100*b* adjacent to the first display region 100*a*. Note that the areas of the first and second display regions 100*a* and 100*b* are dependant on design demands and are not limited by the illustration in FIG. 2.

Figure 3:
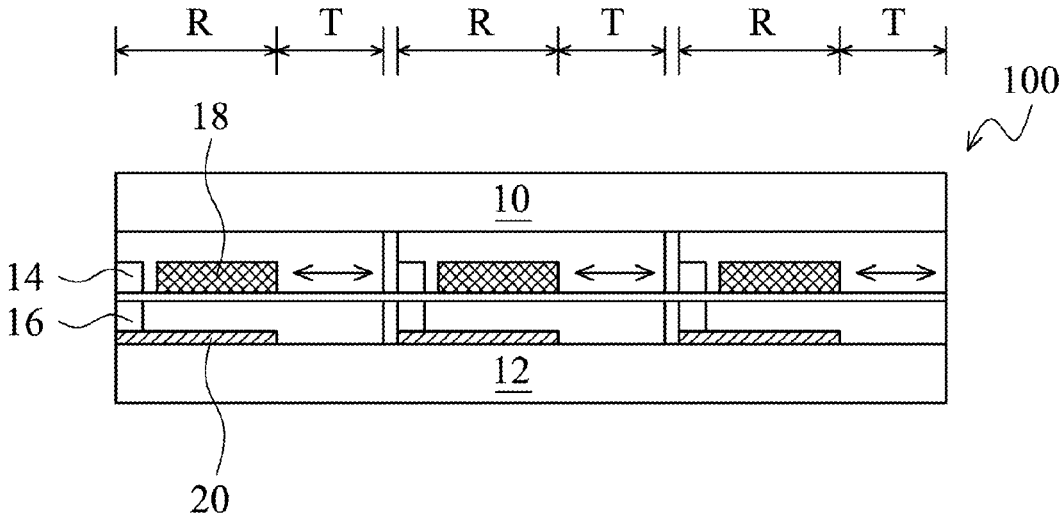
FIG. 3 is a cross section view of an exemplary embodiment of a transflective display panel according to the invention.

Referring to FIG. 3, which is a cross section view of an exemplary embodiment of a transflective display panel 100 according to the invention. In the embodiment, the transflective display panel 100 is a micro-electro-mechanical system (MEMS) display panel. Each pixel of the transflective display panel 100 comprises an upper substrate 10, a lower substrate 12, and a micro-electro-mechanical system (MEMS) shutter 18 interposed between the upper and lower substrates 10 and 12. The upper and lower substrates 10 and 12 may comprise glass, quartz, or other transparent materials. Moreover, the upper and lower substrates 10 and 12 have a transmissive region T and a reflective region R, in which a reflective layer 20, such as a metal layer or other reflective material layer well known in the art, is disposed on the reflective region R of the lower substrate 12. Additionally, an active thin film transistor (TFT) array (not shown) may be disposed on the upper substrate 10 or the lower substrate 12, and no color filter is used on both of the upper and lower substrates 10 and 12. In one embodiment, the active TFT array may comprise an active layer formed of amorphous silicon. In another embodiment, the TFT array may comprise an active layer formed of low temperature polysilicon (LTPS) to further improve the response time and the gray level of the transflective display panel 100, while reducing power consumption.

The MEMS shutter 18 above the reflective layer 20 is electrically connected to electrodes 14 and 16. Voltage is applied on the electrodes 14 and 16, such that the MEMS shutter 18 moves between the transmissive region T and the reflective region R (indicated as arrows in FIG. 3). In one embodiment, the MEMS shutter 18 may be an interferometric modulator, which is a display device that selectively absorbs and/or reflects light using the principle of optical interference.

Figure 4:
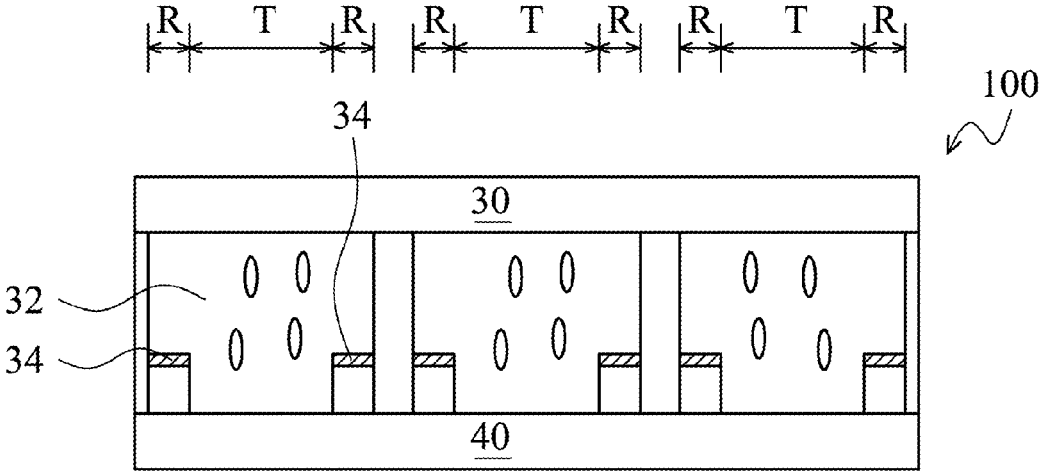
FIG. 4 is a cross section view of another exemplary embodiment of a transflective display panel according to the invention.

Referring to FIG. 4, FIG. 4 is a cross section view of another exemplary embodiment of a transflective display panel 100 according to the invention. In the embodiment, the transflective display panel 100 is an LCD panel. Each pixel of the transflective display panel 100 comprises an upper substrate 30, a lower substrate 40, and a liquid crystal layer 32 interposed between the upper and lower substrates 30 and 40. The upper and lower substrates 30 and 40 may comprise glass, quartz, or other transparent materials. Moreover, the upper and lower substrates 30 and 40 have a transmissive region T and a reflective region R, in which a reflective layer 34, such as a metal layer or other reflective material layer well known in the art, is disposed on the reflective region R of the lower substrate 40. Additionally, an active TFT array (not shown) may be disposed on the upper substrate 30 or the lower substrate 40, and no color filter is used on both of the upper and lower substrates 30 and 40. Also, the active TFT array may comprise an active layer formed of amorphous silicon or LTPS.

Figure 5:
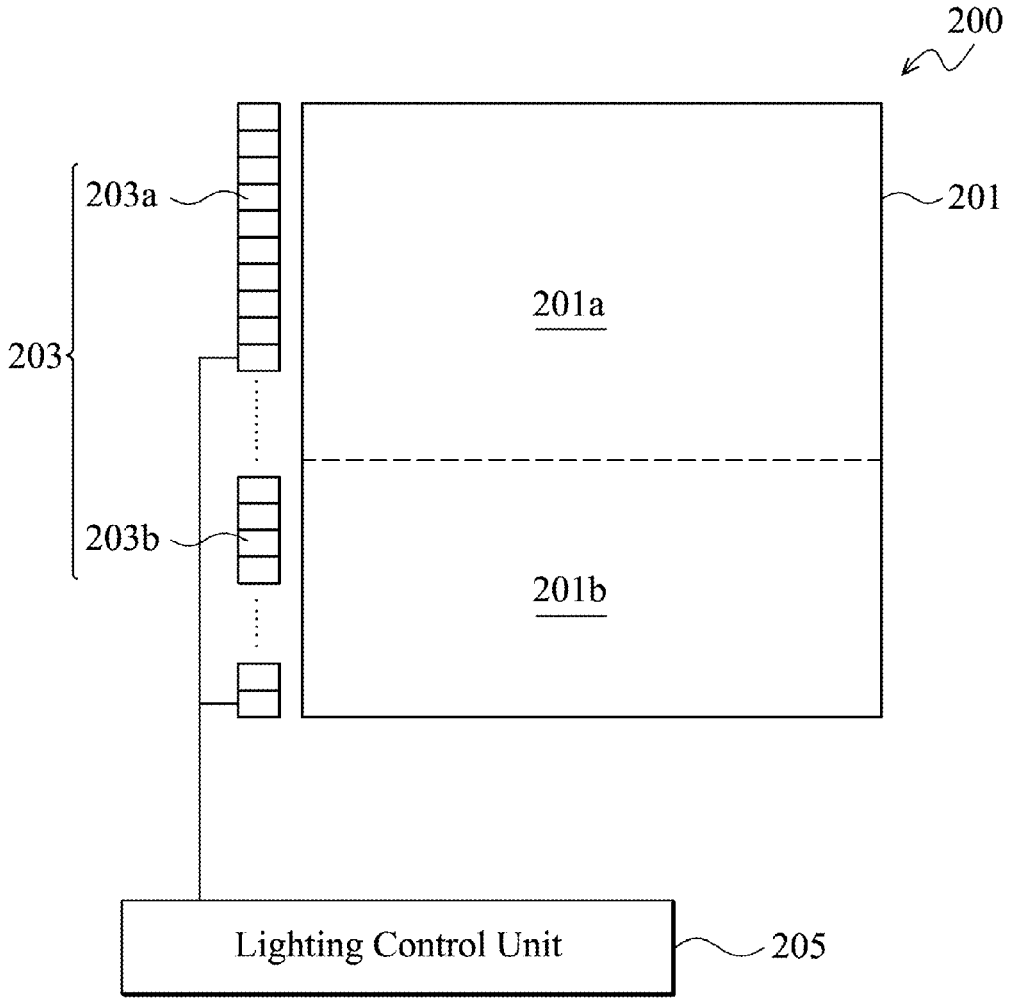
FIG. 5 is a plan view of the exemplary embodiment of the light source module shown in FIG. 1.

Referring to FIG. 5, which is a plan view of the exemplary embodiment of the light source module 200 shown in FIG. 1. The light source module 200 comprises a light guide plate 201, an LED array 203 adjacent thereto, and a lighting control unit 205. In the embodiment, the light guide plate 201 has a first portion 201*a* and a second portion 201*b* adjacent thereto, in which the first portion 201*a* corresponds to the first display region 100*a* of the transflective display panel 100 (as shown in FIG. 2), while the second portion 201*b* corresponds to the second display region 100*b* of the transflective display panel 100 (as shown in FIG. 2).

The LED array 203 comprises a plurality of first LEDs 203*a* and a plurality of second LEDs 203*b*. In the embodiment, the plurality of first LEDs 203*a* corresponds to the first portion 201*a* of the light guide plate 201, such that an emitted light from each first LED 203*a* is transmitted to the first display region 100*a* of the transflective display panel 100 by the first portion 201*a* of the light guide plate 201. Particularly, each first LED 203*a* is a white LED. Moreover, the plurality of second LEDs 203*b* corresponds to the second portion 201*b* of the light guide plate 201, such that an emitted light from each second LED 203*b* is transmitted to the second display region 100*b* of the transflective display panel 100 by the second portion 201*b* of the light guide plate 201. Unlike the plurality of first LEDs 203*a*, the plurality of second LEDs 203*b* may comprise red, green, and blue LEDs. In some embodiments, the plurality of second LEDs 203*b* may further comprise white LEDs, yellow LEDs or a combination thereof, thereby further improving the color quality of the second display region 100*b*. Since no color filter is used in the transflective display panel 100, the first display region 100*a* merely provides black/white display while the second display region 100*b* provides full color display.

The lighting control unit 205 is electrically connected to the LED array 203 (i.e., the plurality of first LEDs 203*a* and the plurality of second LEDs 203*b*), such that the pluralities of first and second LEDs 203*a* and 203*b* are operated in a constant lighting or field sequential mode. When the plurality of first LEDs 203*a* and/or the plurality of second LEDs 203*b* is/are operated in the constant lighting mode, the first display region 100*a* and/or the second display region 100*b* may provide black/white display. When the plurality of first LEDs 203*a* and/or the plurality of second LEDs 203*b* is/are operated in the field sequential mode, the first display region 100*a* provides black/white display while the second display region 100*b* provides black/white or full color display.

According to the foregoing embodiments, since the display panel is a transflective type display panel, it operates in a transmissive or reflective mode in different environments by the selection of the user, such that the FPD device works efficiently. Moreover, since the light source module is operated in a constant lighting or field sequential mode and no color filter is used in the transflective display panel, the resolution and brightness of the FPD device can be increased and the power consumption of the FPD device operated in transmissive mode can be further reduced. Furthermore, since the transflective display panel has a display region for full color display, the display panel can be operated in a video mode. Additionally, since the MEMS shutter or liquid crystal layer is used in the display panel, the display panel has a fast response time, when compared to EPD devices.

Figure 6:
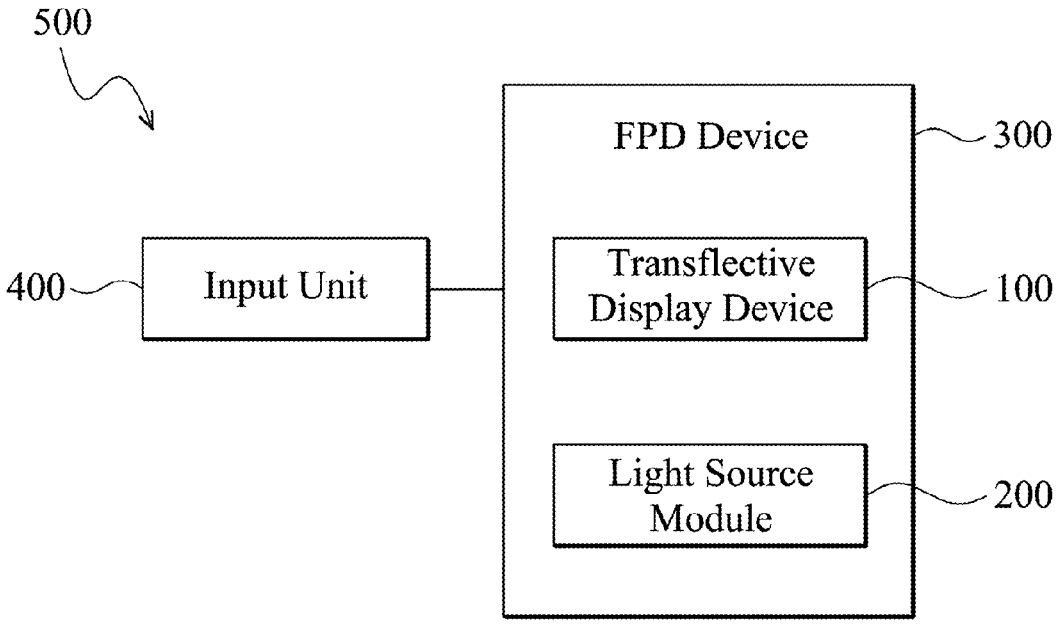
FIG. 6 schematically shows another embodiment of a system for displaying images.

FIG. 6 schematically shows another embodiment of a system for displaying images which, in this case, is implemented as an electronic device 500 such as a projector, an electronic book, a laptop computer, a mobile phone, a digital camera, a personal digital assistant (PDA), a desktop computer, a television, a car display or a portable DVD player. The described transflective display device 100 and light source module 200 can be incorporated into an FPD device 300 which can be a MEMS display device or an LCD device. In some embodiments, the FPD device 300 can be incorporated into the electronic device 500. As shown in FIG. 6, the electronic device 500 comprises the FPD device 300 and an input unit 400. Moreover, the input unit 400 is coupled to the FPD device 300 and is operative to provide input signals (e.g. image signals) to the FPD device 300 to generate images.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A system for displaying images, comprising:

a transflective display panel having a first display region and a second display region adjacent thereto; and a light source module oppositely disposed to the transflective display panel comprising:

a light guide plate having a first portion and a second portion adjacent thereto, wherein the first portion corresponds to the first display region and the second portion corresponds to the second display region;

a plurality of first light-emitting diodes transmitting an emitted light therefrom to the first display region by the first portion of the light guide plate;

a plurality of second light-emitting diodes transmitting an emitted light therefrom to the second display region by the second portion of the light guide plate; and a lighting control unit electrically connected to the plurality of first light-emitting diodes and the plurality of second light-emitting diodes, such that the pluralities of first and second light-emitting diodes are operated in a constant lighting or field sequential mode, wherein each first light-emitting diode is a white light-emitting diode and the plurality of second light-emitting diodes comprises red, green, and blue light-emitting diodes.

2. The system of claim 1, wherein the plurality of second light-emitting diodes further comprises white or yellow light-emitting diodes or a combination thereof.

3. The system of claim 1, wherein the transflective display panel is a micro-electro-mechanical system display panel or a liquid crystal display panel.

4. The system of claim 1, wherein the transflective display panel comprises an active thin film transistor array having an active layer formed of amorphous silicon or low temperature polysilicon.

5. The system of claim 1, wherein the light source module is disposed under a non-viewable side of the transflective display panel.

6. The system of claim 1, wherein the light source module is disposed above a viewable side of the transflective display panel.

7. The system of claim 1, wherein no color filter is used in the transflective display panel.

8. The system as claimed in claim 1, further comprising:

a flat panel display device comprising the transflective display panel and the light source module; and an input unit coupled to the flat panel display device and operative to provide input singles to the flat panel display device, such that the flat panel display device displays images.

9. The system of claim 8, wherein the system is an electronic device comprising the flat panel display device.

10. The system of claim 9, wherein the electronic device is a projector, an electronic book, a laptop computer, a mobile phone, a digital camera, a personal digital assistant, a desktop computer, a television, a car display or a portable DVD player.

11. The system of claim 1, wherein the lighting control unit is capable of being operated in constant lighting and field sequential modes.

* * * * *